US009098972B2

(12) United States Patent
Shimabukuro et al.

(10) Patent No.: US 9,098,972 B2
(45) Date of Patent: Aug. 4, 2015

(54) ELECTRONIC GAMING MACHINE CONFIGURATION USING AN IMPROMPTU CONFIGURATION CHANNEL

(71) Applicant: WMS Gaming, Inc., Waukegan, IL (US)

(72) Inventors: Jorge Luis Shimabukuro, Las Vegas, NV (US); Ranjan Dasgupta, Naperville, IL (US)

(73) Assignee: WMS GAMING, INC., Waukegan, IL (US)

( * ) Notice: Subject to any disclaimer, the term of this patent is extended or adjusted under 35 U.S.C. 154(b) by 0 days.

(21) Appl. No.: 13/786,642

(22) Filed: Mar. 6, 2013

(65) Prior Publication Data

US 2014/0087863 A1 Mar. 27, 2014

Related U.S. Application Data

(60) Provisional application No. 61/705,246, filed on Sep. 25, 2012.

(51) Int. Cl.
*G07F 17/32* (2006.01)

(52) U.S. Cl.
CPC ..... *G07F 17/3241* (2013.01)

(58) Field of Classification Search
CPC ... G07F 17/32; G07F 17/326; G07F 17/3225; G07F 17/3227; G07F 17/3234; G07F 17/3232; G07F 17/3241; G07F 17/3269; A63F 2300/40–2300/409
See application file for complete search history.

(56) References Cited

U.S. PATENT DOCUMENTS

| | | | | |
|---|---|---|---|---|
| 6,439,996 | B2 | 8/2002 | LeMay et al. | |
| 6,884,173 | B2 | 4/2005 | Gauselmann | |
| 7,641,555 | B2 | 1/2010 | McKinley et al. | |
| 7,785,204 | B2 * | 8/2010 | Wells et al. | 463/42 |
| 8,414,394 | B2 | 4/2013 | Kovacic et al. | |
| 2004/0048669 | A1 * | 3/2004 | Rowe | 463/42 |
| 2008/0248879 | A1 * | 10/2008 | Smith | 463/42 |
| 2008/0274795 | A1 * | 11/2008 | Carpenter et al. | 463/25 |
| 2010/0217992 | A1 * | 8/2010 | Hamlin et al. | 713/176 |
| 2010/0311500 | A1 * | 12/2010 | Canterbury et al. | 463/29 |
| 2011/0053679 | A1 * | 3/2011 | Canterbury et al. | 463/24 |
| 2011/0195786 | A1 * | 8/2011 | Wells | 463/42 |
| 2012/0115564 | A1 * | 5/2012 | Canterbury et al. | 463/20 |
| 2013/0072304 | A1 * | 3/2013 | Brosnan et al. | 463/42 |
| 2013/0311500 | A1 * | 11/2013 | Milone et al. | 707/758 |

FOREIGN PATENT DOCUMENTS

WO WO-2007/032943 A1 3/2007

* cited by examiner

*Primary Examiner* — James S McClellan
*Assistant Examiner* — Kevin Carter
(74) *Attorney, Agent, or Firm* — Miller, Matthias & Hull LLP

(57) ABSTRACT

An electronic gaming machine (EGM) may use a temporary network to perform configuration updates upon determining that a maintenance mode is active and that normal gaming operation is suspended. The temporary network may use cryptographically paired wireless devices that prevent man-in-the-middle attacks or eavesdropping. Alternatively, the temporary network may use an existing network that is utilized during normal gaming operation for accessories and/or loyalty data. Once the temporary, or ad hoc, network is established, a host electronic gaming machine or a standalone device may be used as a repository from which configuration information may be propagated to other electronic gaming machines, even if the other electronic gaming machines have a different games or configurations from that of the host. This capability may be particularly helpful in jurisdictions where EGM networking is prohibited during game play operation.

19 Claims, 7 Drawing Sheets

ELECTRONIC GAMING MACHINE CONFIGURATION USING AN IMPROMPTU CONFIGURATION CHANNEL

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE DISCLOSURE

The present disclosure relates generally to gaming systems and methods, and more particularly to configuring electronic gaming machines using an impromptu network.

BACKGROUND OF THE DISCLOSURE

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

In order to maintain and revise gaming machines, updates to operating systems, games, configuration files, etc., may be performed. However, in some jurisdictions, the use of computer networks in gaming system environments is restricted by regulations.

SUMMARY OF THE DISCLOSURE

According to one aspect of the present disclosure a gaming system includes a first electronic gaming machine with a processor, a non-volatile memory, a first electronic module that senses a physical state of the electronic gaming machine and places the electronic gaming machine in a first mode for normal operation when in a first physical state or places the electronic gaming machine in a second mode for update operation when in a second physical state. The electronic gaming machine may include a second electronic module that senses a logical state of the electronic gaming machine and enables update operation of the electronic gaming machine when an update logical state of the electronic gaming machine is active. The first electronic gaming machine may also include a network interface that communicates update information only when the electronic gaming machine is operating in the second mode and is enabled for update operation. The gaming system may also include a second electronic gaming machine communicatively connected to the first electronic gaming machine that communicates update information with the first electronic gaming machine when the first electronic gaming machine is configured to communicate update information. The gaming system may further include a network that provides data transport between the first electronic gaming machine and the second electronic gaming machine at least when the first electronic gaming machine is configured to communicate update information.

Figure 1:
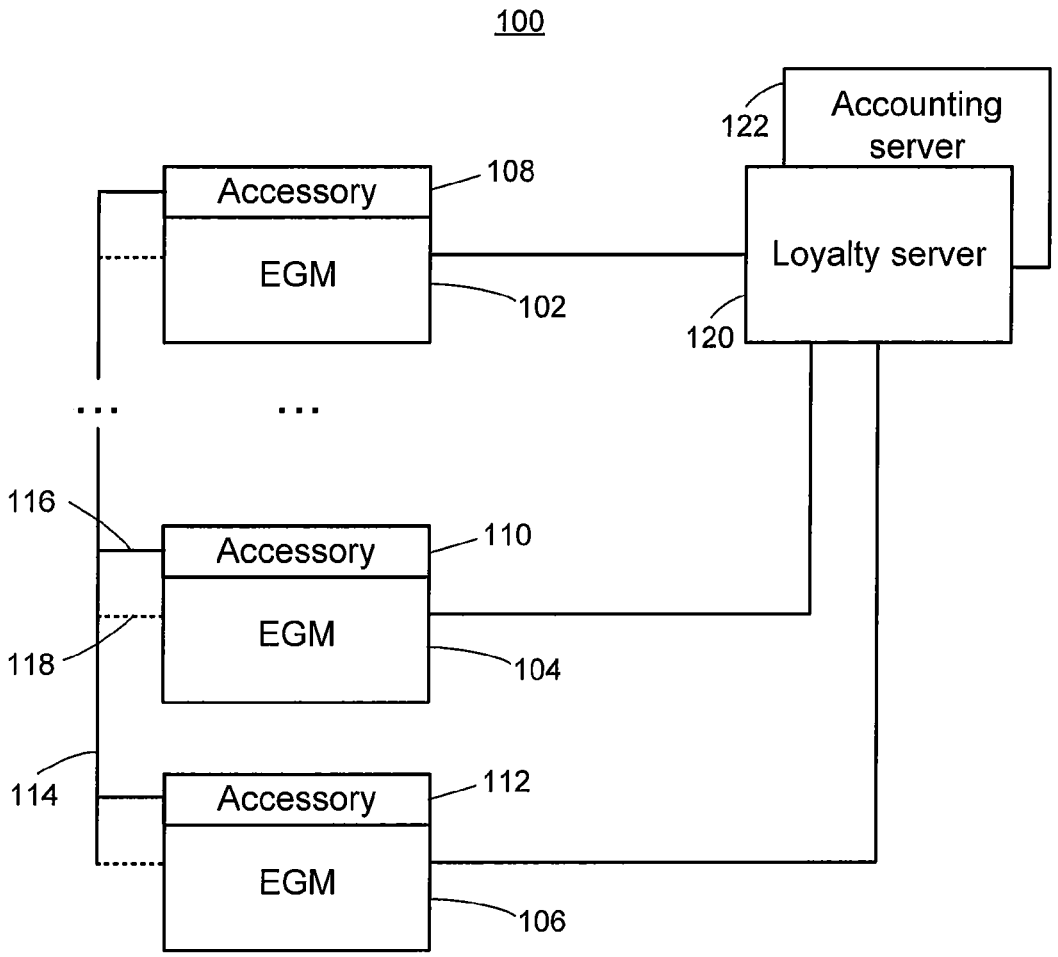
FIG. 1 is a block diagram that illustrates an exemplary system supporting electronic gaming machine configuration using an impromptu network.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the appended claims.

DETAILED DESCRIPTION

Reference will now be made in detail to specific embodiments or features, examples of which are illustrated in the accompanying drawings. Generally, corresponding reference numbers will be used throughout the drawings to refer to the same or corresponding parts. While the present disclosure may be embodied in many different forms, the embodiments set forth in the present disclosure are to be considered as exemplifications of the principles of the present disclosure and are not intended to be limited to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

At least occasionally, many electronic gaming machines will need to have an update or replacement of some aspect of its software or firmware, such as, but not limited to, an operating system, configuration files, payout tables, or the game itself. However, in many cases either for security reasons or because of gaming system regulations, electronic gaming machines may be prohibited from communicating via a data network. In that case, should an update be required, each machine may need to be manually updated by a service person. On even a small gaming floor such a manually intensive process both ties up maintenance personnel and reduces the amount of time a particular gaming machine is available for beneficial use.

The use of an impromptu, or ad hoc, network that is available for use only during maintenance operation of an electronic gaming machine may be used to address both the regulatory concerns and the business concerns of this situation. Use of an impromptu network supports the introduction of a master storage device from which updates may be made or permits an individual electronic gaming machine to act as a source repository for updates to other electronic gaming machines. A variety of physical and/or logical conditions may be enforced to ensure that the impromptu network is used only during maintenance operation and is not functional during normal use.

Figure 2:
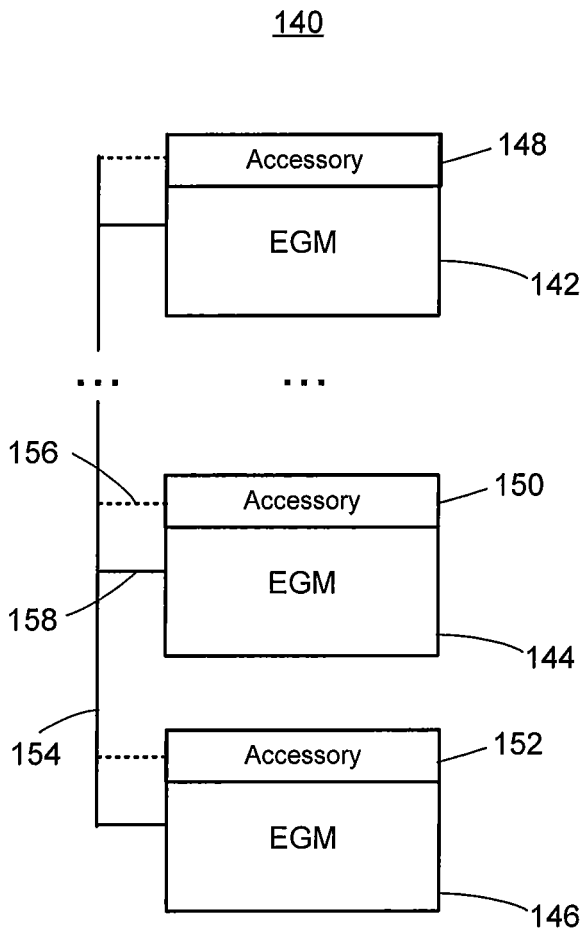
FIG. 2 is another block diagram that illustrates another configuration of an exemplary system supporting electronic gaming machine configuration using an impromptu network.
Figure 3:
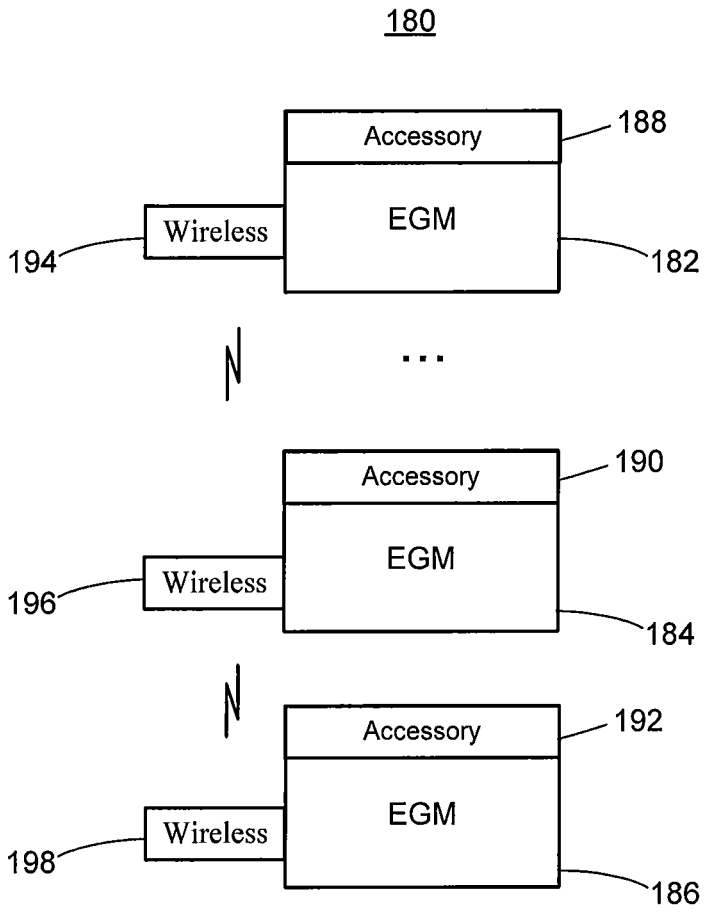
FIG. 3 is another block diagram that illustrates yet another configuration of an exemplary system supporting electronic gaming machine configuration using an impromptu network.

FIG. 1-FIG. 3 illustrate various configurations of electronic gaming machines in systems suitable for supporting impromptu networks for configuration updates.

FIG. 1 is a block diagram that illustrates an exemplary gaming system 100 supporting electronic gaming machine configuration using an impromptu network. The gaming system 100 includes a plurality of electronic gaming machines 102, 104, 106 representing virtually any number of electronic gaming machines that may be included in a gaming bank or gaming floor, for example, in a casino. Each of the electronic gaming machines may include one or more accessories, such as accessories 108, 110, 112 coupled to respective electronic gaming machines 102, 104, 106. In one embodiment, a wired network 114 may couple the electronic gaming machines 102, 104, 106, and more particularly may allow communication between each gaming machine's respective accessory or accessories. In one exemplary embodiment, the network 114 is an RS485 network using an appropriate data protocol to coordinate a lighting display among each of the various electronic gaming machines 102, 104, 106 using accessory lighting banks (not depicted). In some embodiments, features such as accessory lighting banks may have their own processors with separate connections to network 114.

As illustrated in FIG. 1, the network 114 is shown as being connected to each accessory, 108, 110, 112 via a first network portion 116. A second network portion 118, logically coupled to each respective electronic gaming machine 102, 104, 106 is illustrated in FIG. 1 as being disabled.

A loyalty server 120 and an accounting server 122 are also shown coupled to each electronic gaming machine by dedicated links. The loyalty server 120 may collect information from an individual electronic gaming machine 102 related to presence of a particular patron and his or her wagering pattern. The accounting server 122 may collect information regarding wagers placed and payout history. This highly simplified example of a gaming system 100 is used to illustrate electronic gaming machine configuration for use with an impromptu network. Other system layouts, game particulars, alternative networks, and supporting servers or other equipment may be present in other embodiments.

With respect to FIG. 1, the network 114, coupling each accessory bank is illustrative of a configuration used during normal operation, that is, when each electronic gaming machine 102, 104, 106, is operating in either an attract mode or a game play mode. In attract mode, a gaming machine 102 may display information about how a game is played and also may present lights and sounds designed to attract a patron to use that machine. In game play mode, a patron may have approached the machine and/or added value to the machine causing the electronic gaming machine to support its particular wagering game.

In accordance with a security policy of a particular establishment or in accordance with statutory requirements, communication between gaming machines via the network 114 may be prohibited during normal operation, including during game play. Therefore, as illustrated in FIG. 1, the second network portion 118 may be deactivated during game play mode.

FIG. 2 is another block diagram that illustrates another configuration of an exemplary gaming system 140 supporting an electronic gaming machine configuration using an impromptu network. In a similar fashion to the system 100 of FIG. 1, a plurality of electronic gaming machines 142, 144, 146 may include respective accessory banks 148, 150, 152. An exemplary wired network 154, the same as or similar to the wired network 114 of FIG. 1, is illustrated as having accessory links 156 disabled and the second network portion 158 coupled directly to each electronic gaming machine 142, 144, 146, as being enabled.

In a security or regulatory environment such as that discussed above with respect to FIG. 1, such a configuration may not be allowed during normal operation. The exemplary embodiment of FIG. 2 may therefore be appropriate only during maintenance operation. Converting the gaming system 140 or an individual electronic gaming machine 142 to maintenance operation is discussed in more detail below.

FIG. 3 is another block diagram that illustrates another configuration of an exemplary system 180 supporting electronic gaming machine configuration using an impromptu network. Similar to the embodiments discussed above with respect to FIG. 1 and FIG. 2, a plurality of electronic gaming machines 182, 184, 186 and their respective accessory banks 188, 190, 192 may be connected via a plurality of wireless network devices 194, 196, 198. The wireless devices 194, 196, 198 may be any of a number of known wireless communication devices, such as Wi-Fi, Bluetooth, or Zigbee, using any of a number of public or proprietary communication protocols such as TCP/IP, etc. Similar to FIG. 2, FIG. 3 may illustrate a networking arrangement used only during maintenance operation. The wireless devices 194, 196, 198 may be removably attached to the respective gaming machines and may be present only during maintenance operation.

Figure 4:
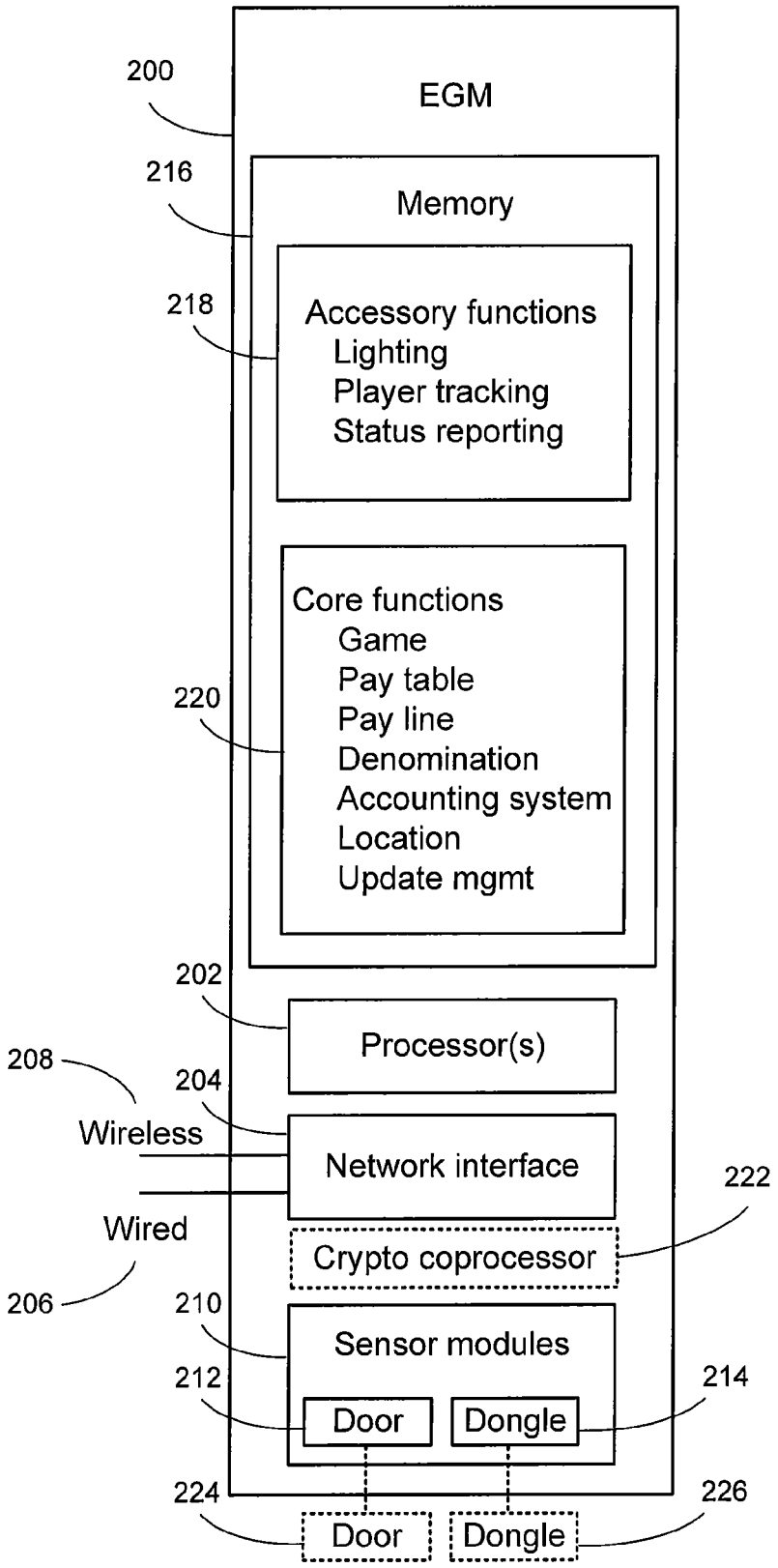
FIG. 4 is a block diagram of an exemplary electronic gaming machine suitable for use in a system supporting electronic gaming machine configuration using an impromptu network.

FIG. 4 is a block diagram of an exemplary electronic gaming machine 200 suitable for use in a system supporting electronic gaming machine configuration using an impromptu network. The electronic gaming machine 200 may include one or more processors 202, a network interface 204 with one or both of a wired port 206 and wireless port 208 supporting one or more network protocols. The electronic gaming machine 200 may also include one or more sensor modules 210. When a predetermined physical state is required for impromptu network access, the presence of one or more physical states may need to be determined. To support determination of the physical state of the electronic gaming machine 200, the sensor modules 210 may include a door sensor 212 and a dongle sensor 214. For example, a maintenance door 224 may be monitored for its physical state by the door sensor 212 and may report states such as open/closed and/or locked/unlocked. In an embodiment, only when the door sensor 212 determines that the maintenance door 224 is unlocked, open, or both will configuration updates via a network be permitted.

Similarly, a dongle sensor 214 may be used to determine whether an add-on device 226 is physically plugged into either the network interface 204 or another port of the electronic gaming machine 200, such as a Universal Serial Bus (USB) port. The dongle 226 may be in the form of a wired or wireless network device or may be a security token that participates in providing cryptographic authentication of an authorized maintenance employee. In some cases, as discussed further below with respect to FIG. 5, the dongle 226 can have both functions. That is, the dongle 226 may include a wireless network function as well as provide cryptographic authentication.

The electronic gaming machine 200 may also include a memory 216. The memory 216 may include one or more kinds of physical volatile or nonvolatile computer-readable memory such as ROM, RAM, rotating media, flash memory, or other physical structures capable storing computer data readable by the processor 202, but does not include propagated media such as carrier waves. The memory 216 may include modules or functions that when executed by the processor 202 cause various software or hardware operations to be performed. For example, under the control of output devices coupled to the processor 202, such as lights, display devices, speakers, haptic devices, etc., may be activated to provide a rich sensory experience to a gaming machine patron. So, while the software modules or functions stored may be stored in memory 216, their execution has, in most cases, a corresponding physical manifestation. The memory 216 may be at least logically partitioned into accessory functions 218 and core functions 220. To the extent that core functions 220 may have different access and security classifications, the partitioning may be physical as well, that is, having separate memory structures with different physical security attributes.

Accessory functions 218 may include one or more lighting functions used during attract and game play mode operation, player tracking functions discussed above, status reporting, etc. In general, accessory functions do not affect game play or game outcomes and do not need protection from updating during normal operation. As discussed above, accessory functions may use network connections to coordinate lighting effects between gaming devices or to report patron loyalty information to a loyalty server 120.

In contrast, core functions 220 may include those functions that are critical to game operation and game outcomes. These may include, but are not limited to, the game itself, a pay table specifying outcome percentages, pay line information, currency denomination, accounting system details, a location of the machine, and modules that manage the update process. The core functions 220 may reside in a protected memory space that can only be updated after certain conditions have been met. In one embodiment, those conditions may include both a physical state of the gaming machine 200, such as presence of a security token and a logical state, such as an administrative login account successfully logged into and is active. In another embodiment, the physical state of the gaming machine 200 may be or include a maintenance door being unlocked and open.

In operation, one embodiment may configure the network interface 204 either physically or logically so that during normal operation (e.g., attract mode or game play mode) the wireless port 208 is disabled and the wired port 206 is only available for accessory functions 218. This can be accomplished by a program executed by the processor 202 or may be a result of physical interlocks tied, for example, to the maintenance door 224. Another embodiment may use separate dedicated network interfaces for accessory use and for update activities. During normal operation, the dedicated network interface used for update data transfers may be turned off or removed from an operational memory space of the electronic gaming machine, as would be understood by one of ordinary skill in the art. In another example, a relay could be physically activated to divert traffic away from a gaming processor to a separate processor (not depicted) supporting accessory functions, such as coordinated lighting effects.

When the electronic gaming machine 200 meets the criteria set forth for network-based update programming, the network interface 204 may be configured to enable the wired port 206, the wireless port 208, or both to support traffic used to update data of the core functions 220 area of memory 216.

An optional cryptographic coprocessor 222 may be used to perform cryptographic authentications associated with placing the electronic gaming machine 200 in a maintenance mode. For example, the cryptographic coprocessor 222 may be used to authenticate the dongle 226 or other security token, a remote device connected via the wired or wireless networks, maintenance personnel credentials or some combination of these.

Figure 5:
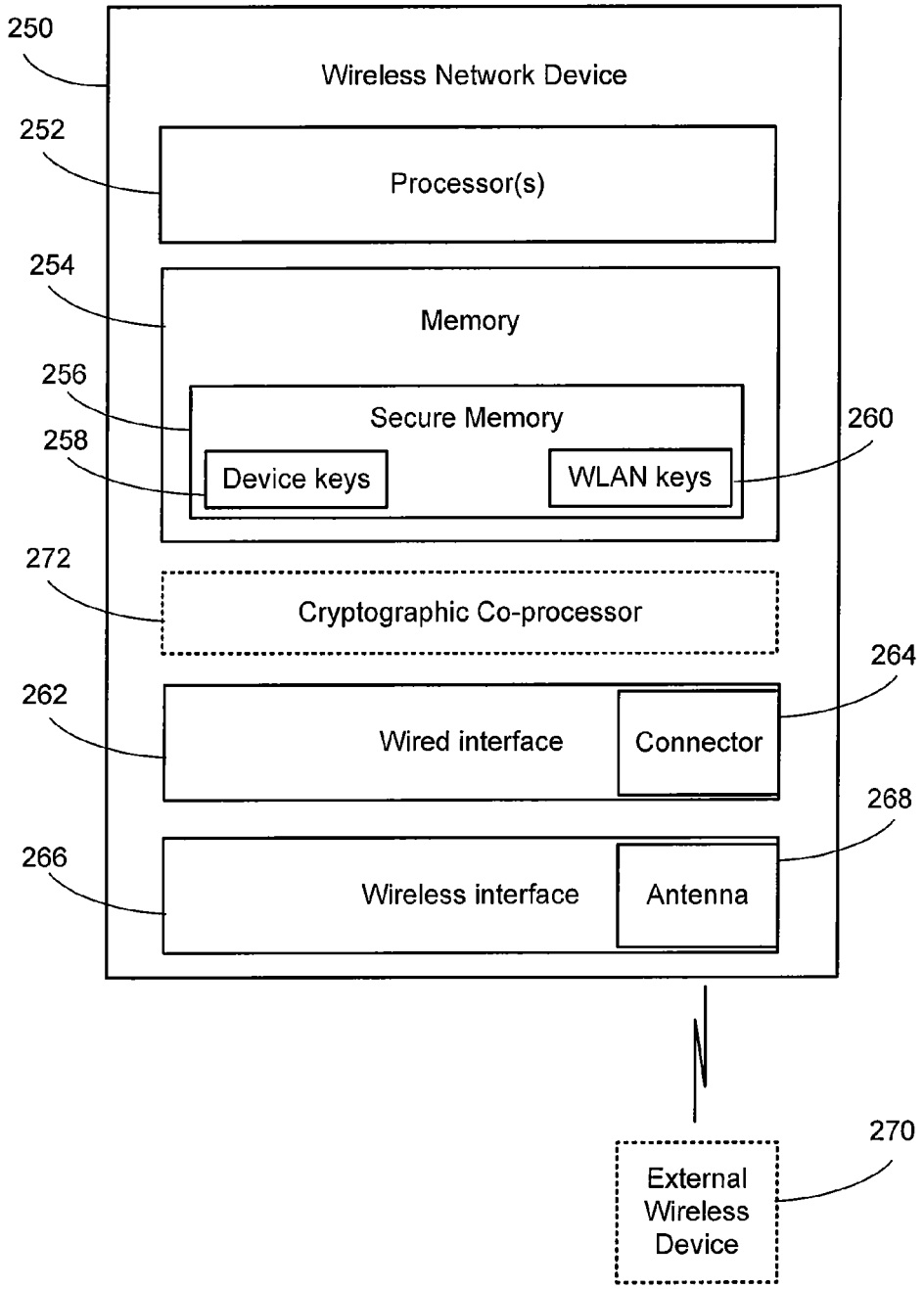
FIG. 5 is a block diagram of an exemplary wireless network device suitable for use in a system supporting electronic gaming machine configuration using an impromptu network.

FIG. 5 is a block diagram of an exemplary wireless network device 250 suitable for use in a system supporting electronic gaming machine configuration using an impromptu network. The wireless network device 250 may include one or more processors 252. The wireless network device 250 may also include a memory 254 that may be embodied by one or more kinds of physical volatile and nonvolatile memory devices such as ROM, RAM, rotating media, flash memory, or other physical structures capable storing computer data readable by the processor 252, but does not include propagated media such as carrier waves. Within the memory 254 may be a secure memory 256 used, for example, to store device keys 258 and wireless network keys 260 as discussed in more detail below. The device key 258 and the wireless network key 260 or keys may be burned into the secure memory 256 during manufacturing or may be in memory locations requiring cryptographic authentication before the keys may be altered. Smartcard chips represent one technique for securing keys in this fashion.

The wireless network device 250 may also include a wired interface 262 with a connector 264 for use in attaching to an electronic gaming machine such as electronic gaming machine 200 of FIG. 4. The connector 264 may, in some embodiments, be a USB-type connector. The wireless network device 250 may also include a wireless interface 266 with an attached antenna 268. The antenna 268 may be internal to the wireless network device 250 or may have an external component. The wireless interface 266 may be programmed to communicate with another wireless device 270 attached, for example, to a different electronic gaming machine. See, e.g., FIG. 3. In one embodiment, the wireless network device 250 and the other wireless device 270 may be paired at the time of manufacturing with corresponding wireless network keys 260 so that only that pair of devices can talk to each other and all communication may be encrypted with these preset keys so that eavesdropping or a man-in-the-middle attack may be prevented. In another embodiment, normal device pairing and key exchange techniques may be used to protect communication between wireless devices 250 and 270.

A cryptographic coprocessor 272 may optionally be used to support authentication and encryption.

In one embodiment, the wireless network device 250 upon being plugged into an electronic gaming machine 200 may participate in an authentication process whereby the electronic gaming machine 200 may authenticate the wireless device 250 as being authorized for use in a wireless configuration update process. This would require that the electronic gaming machine 200 have private keys or a public key certificate that would allow the wireless network device 250 to authenticate itself.

In yet another embodiment, either on its own or at the request of the electronic gaming machine 200, the wireless network device 250 may perform a one-way or mutual authentication of the external wireless device 270 to assure itself that it is communicating with a bona fide participant in the configuration data update process. This may reduce the chance that a rogue wireless network device could be used to provide unauthorized update information.

Figure 6:
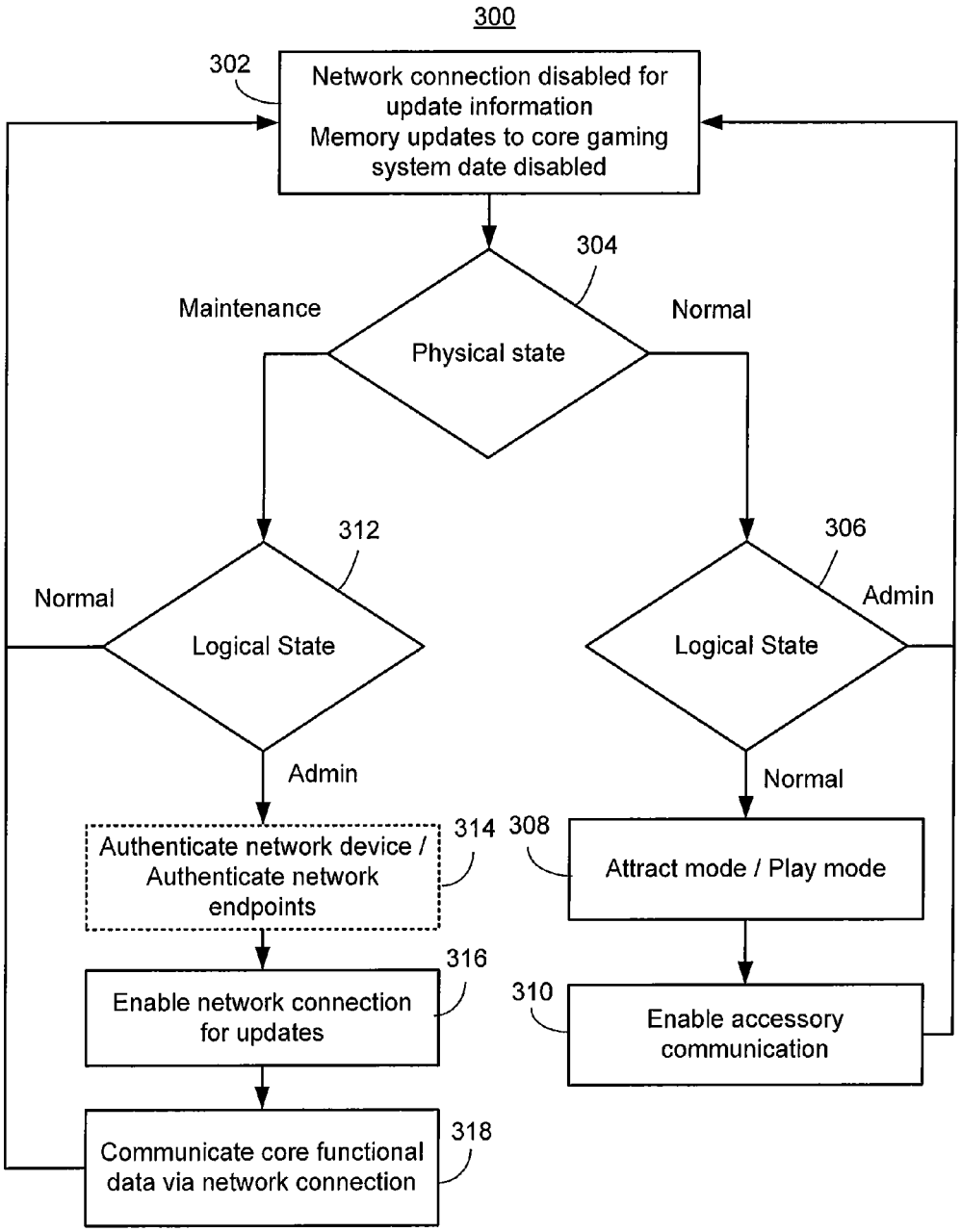
FIG. 6 is flowchart of a method of configuring an electronic gaming machine using an impromptu network.

FIG. 6 is a flowchart of a method 300 of configuring an electronic gaming machine using an impromptu network. At a block 302, an electronic gaming machine, such as electronic gaming machine 200 of FIG. 4 may be started. It is assumed that all maintenance doors are closed, any network connections are disabled for update information transfer, and that memory updates to core function data is disabled. At a block 304, a physical state of the electronic gaming machine 200 may be determined. If the physical state indicates a normal physical condition, the 'normal' branch from block 304 may be followed to a block 306. At the block 306, a logical state of the electronic gaming machine 200 may be checked. If, at block 306, the logical state is determined to be normal, the 'normal' branch may be followed to a block 308. At the block 308, the electronic gaming machine 200 may be placed in a normal operating mode and depending on patron participation either an attract mode or a game play mode may be engaged. If applicable, at a block 310, accessory operation may be activated. This may include communication between participating electronic gaming machines, such as illustrated in FIG. 1 and may include lighting coordination, loyalty program data and accounting data. The process may continue at block 302.

If, at block 306, the electronic gaming machine is logically in an administrative state, but the physical state is normal (from block 304), certain administrative functions may be enabled. In some embodiments, being in the administrative logical state may be sufficient to allow network-based core data updates. In other embodiments, however, core data updates may not be allowed in this combination of states and execution may be returned to block 302.

If, at block 304, the electronic gaming machine 200 is determined to be in a maintenance state, for example, if a maintenance door 224 is unlocked and open, an authenticated dongle 226 is present, or both, the 'maintenance' branch may be followed to a block 312. At the block 312, the logical state of the electronic gaming machine 200 may be checked. If the logical state is normal, the 'normal' branch may be taken from block 312 and control returned to block 302. In other embodiments, the physical state being in the maintenance mode may be sufficient to allow use of the impromptu network for core function updates.

If, at block 312, the logical state is admin, the 'admin' branch may be taken to a block 314. The admin state may be entered into any of several ways, including, but not limited to, a login, a login combined with a security token, the security token by itself, physical access to the machine via a locked door, physical access combined with a token, or physical access combined with a login. Optionally, at the block 314, an authentication of an attached network device, such as wireless network device 250 of FIG. 5 may be performed. In addition, the electronic gaming machine 200 may request that the network device perform an authentication of either or both of a destination wireless network device 270 or the ultimate destination electronic gaming machine, such as might be performed between electronic gaming machine 184 and electronic gaming machine 186 of FIG. 3.

Whether or not block 314 is executed, a block 316 may enable the network for updates to the core gaming system functions 220. This may involve reconfiguration of a wired network, such as wired network 154 of FIG. 2 that is most often used for accessory data or may use an entirely ad hoc network established, for example, by connection of wireless network devices 250, 270.

At a block 318, the electronic gaming machine 200 may use the network to transfer data to or from the core functions area of the memory 216. There are many ways in which the actual transfer may be accomplished. Among them, one electronic gaming machine, e.g., electronic gaming machine 144, may be manually updated using a physically attached device, such as a DVD drive, and then that machine may then be used as a source repository to download core function data to the other electronic gaming machines, e.g., electronic gaming machines 142, and 146. Such an approach is suitable for both the wire network and wireless network implementations. The source machine may even store data relevant to other machines as well as that relevant to its own configuration so that one machine can be used as a source for different electronic gaming machines. Another alternative is to use a wireless network device to attach to a network drive, such as a wireless device configured to look like a disk drive. Another embodiment may use a 'cloud' drive or other distributed network drive. In some cases, different machines may be used as sources for particular sets of configuration data. For example, one electronic gaming machine may be a source for game data and another electronic gaming machine may be a source for pay table data. Other combinations of sources and destinations may be supported.

Figure 7:
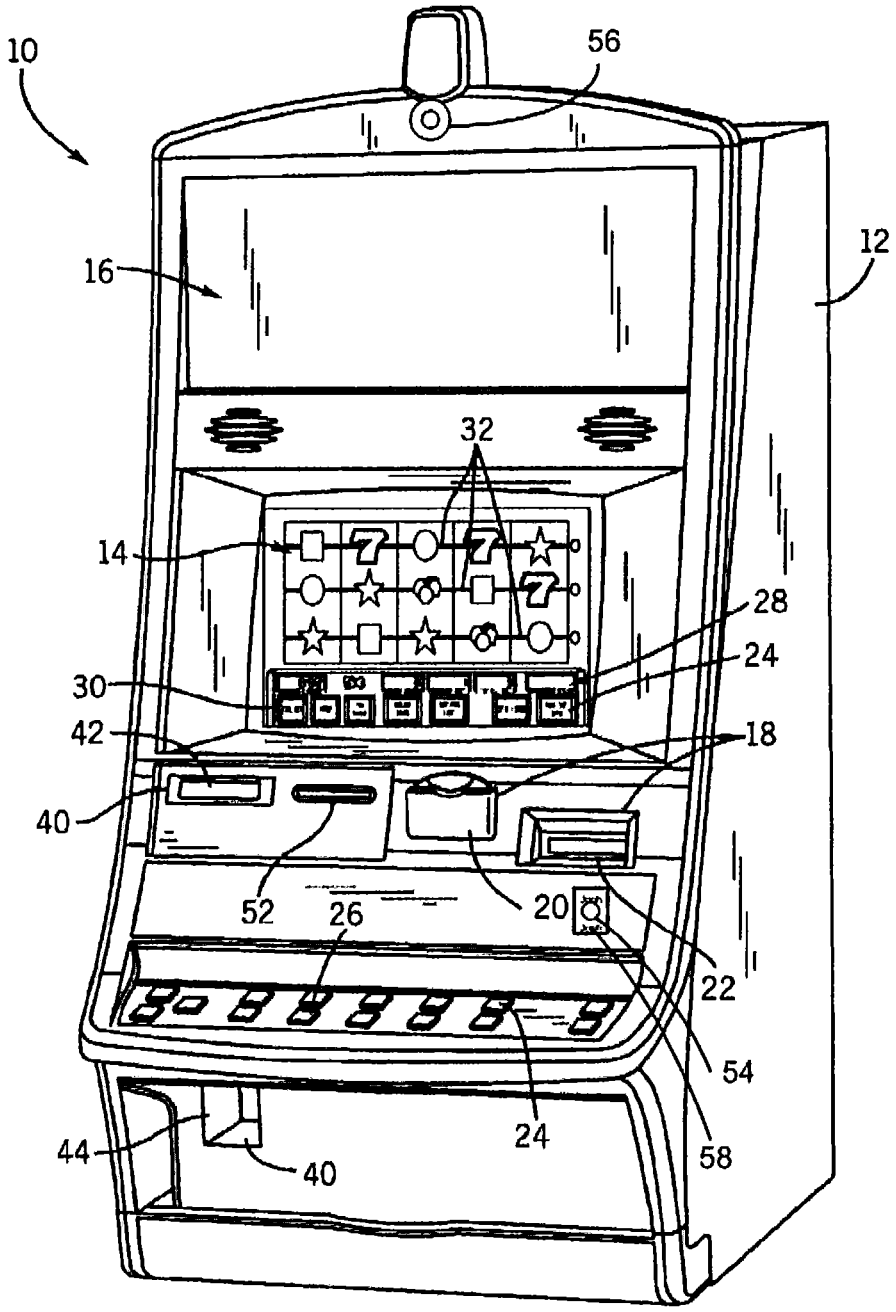
FIG. 7 is a perspective view of a gaming system according to an embodiment of the present disclosure.

FIG. 7 is a perspective view of a gaming machine 10 according to an embodiment of the present disclosure. The gaming machine 10 may be used in gaming establishments such as casinos. The gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as slots, keno, poker, blackjack, roulette, etc. The techniques discussed above with respect to ad hoc network connectivity used for core gaming function updates apply primarily to electronic gaming machines, but the concepts disclosed may be applicable to all types of gaming machines for which memory-based updates are available.

The gaming machine 10 may include a housing 12 and may include input devices, including a value input device 18 and a player input device 24. For output, the gaming machine 10 may include a primary display 14 for displaying information about the basic wagering game. The primary display 14 may also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 may receive currency and/or credits that may be inserted by a player. The value input device 18 may include a coin acceptor 20 for receiving coin currency. Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 may include a plurality of push buttons 26 on a button panel for operating the gaming machine 10. In addition, or alternatively, the player input device 24 may include a touch screen 28 mounted by adhesive, tape, or the like over the primary display 14 and/or secondary display 16. The touch screen 28 may include soft touch keys 30 denoted by graphics on the underlying primary display 14 and may be used to operate the gaming machine 10. The touch screen 28 may provide players with an alternative method of input. A player may enable a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of operating the game, while the touch keys 30 may allow for input needed for another aspect of the game. In some embodiments, a physical player sensor 56 may also be included. The physical player sensor 56 may be a camera or a biometric sensor or a motion detecting device. The physical player sensor 56 may be used to provide inputs to the game, such as images, selection motions, biometric data and other physical information.

The various components of the gaming machine 10 may be connected directly to, or contained within, the housing 12, as seen in FIG. 7, or may be located outboard of the housing 12 and connected to the housing 12 via a variety of different wired or wireless connection methods. Thus, the gaming machine 10 may include these components whether housed in the housing 12, or outboard of the housing 12 and connected remotely. As discussed above, these wired or wireless connections may be used to communicate accessory information or may be used on a temporary basis to transfer update information.

The operation of the basic wagering game may be displayed to the player on the primary display 14. The primary display 14 may also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 may include the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 may be slanted at about a thirty-degree angle toward the player of the gaming machine 10.

A player may begin play of the basic wagering game by making a wager via the value input device 18 of the gaming machine 10. A player may select play by using the player input device 24, via the buttons 26 or the touch screen keys 30. The basic game may include of a plurality of symbols arranged in an array, and may include at least one payline 32 that indicates one or more outcomes of the basic game. Such outcomes may be randomly selected in response to the wagering input by the player. At least one of the plurality of randomly-selected outcomes may be a start-bonus outcome, which may include any variations of symbols or symbol combinations triggering a bonus game.

In some embodiments, the gaming machine 10 may also include a player information reader 52 that allows for identification of a player by reading a card 54 with player information 58 indicating his or her true identity. The player information reader 52 is shown in FIG. 7 as a card reader, but may take on many forms including a ticket reader, bar code scanner, RFID transceiver or computer readable storage medium interface. Currently, player information 58 may be generally used by casinos for rewarding certain players with complimentary services or special offers. For example, a player may be enrolled in the gaming establishment's loyalty club and may be awarded certain complimentary services as that player collects points in his or her player-tracking account. The player may insert his or her card 54 into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to recall or restore game assets that the player achieved and saved during a previous game session either in the gaming establishment or on a separate computing device at a different location. Other embodiments of the gaming machine 10 are possible, such as handheld or mobile gaming machine (not depicted). While an embodiment of gaming machine configuration is described with respect to casino floor games, the equipment and method are equally applicable to handheld or mobile gaming machines for which an ad hoc and secure mechanism for updating software and configuration are desired.

In summary, an impromptu network may be used to reduce downtime associated with electronic gaming machine maintenance by allowing a source device to update other electronic gaming machines only when a set of logical and/or physical conditions are met. As opposed to Internet environments, where one network adapter and physical network connection may be used for both open and secure connections (e.g., Transport Layer Security or Secure Socket Layer), a gaming system implementation using impromptu networks for core function data updates may use a combination of logical and physical gating conditions to determine whether to allow such network connections and the associated update processing. The benefit to gaming system owners or operators is realized both through the ability to comply with regulations prohibiting networking during normal operation and through the reduced downtime associated with performing more efficient updates during maintenance periods.

Each of these embodiments and obvious variations thereof is contemplated as falling within the spirit and scope of the present disclosure as defined and set forth in the following claims. Moreover, the present concepts expressly include any and all combinations and subcombinations of the preceding elements and aspects.

What is claimed is:

1. A gaming system comprising:

a first electronic gaming machine including:

a processor;

a non-volatile memory;

a first electronic module that senses a physical state of the first electronic gaming machine and places the first electronic gaming machine in a first mode for normal operation when in a first physical state or places the first electronic gaming machine in a second mode for update operation when in a second physical state;

a second electronic module that senses a logical state of the first electronic gaming machine and enables update operation of the first electronic gaming machine when an update logical state of the first electronic gaming machine is active;

a first network interface that is active during game play; and a second network interface that operates exclusively when the first electronic gaming machine is operating in the second mode and is enabled for update operation; and a second electronic gaming machine communicatively connected to the second network interface of the first electronic gaming machine, wherein the second electronic gaming machine communicates update information with the first electronic gaming machine when the first electronic gaming machine is operating in the second mode and is enabled for update operation; and a network that provides data transport between the first electronic gaming machine and the second electronic gaming machine at least when the first electronic gaming machine is operating in the second mode and is enabled for update operation.

2. The gaming system of claim 1, wherein the first physical state includes a maintenance door being closed and locked and the second physical state includes the maintenance door being open.

3. The gaming system of claim 2, wherein the update logical state is active following an authenticated log in of an administrative account.

4. The gaming system of claim 1, wherein the network is a wireless network.

5. The gaming system of claim 4, wherein the first physical state is an absence of a wireless communication device attached to the second network interface and the second physical state is a presence of the wireless communication device attached to the second network interface.

6. The gaming system of claim 5, wherein the second physical state further includes the wireless communication device being cryptographically authenticated by the first electronic gaming machine.

7. The gaming system of claim 1, wherein the update logical state of the first electronic gaming machine is active only during an authenticated log in of an administrative account.

8. The gaming system of claim 1, wherein the first physical state is an absence of a cryptographic dongle attached to an input of the first electronic gaming machine and the second physical state is a presence of the cryptographic dongle attached to the second network interface.

9. The gaming system of claim 1, wherein the network is a wired network coupled at least between the first electronic gaming machine and the second electronic gaming machine.

10. An electronic gaming machine comprising:

a processor;

a non-volatile memory;

a first electronic module that senses a physical state of the electronic gaming machine and places the electronic gaming machine in a first mode for normal operation when in a first physical state or places the electronic gaming machine in a second mode for update operation when in a second physical state;

a second electronic module that senses a logical state of the electronic gaming machine and enables updating of the electronic gaming machine when an update logical state of the electronic gaming machine is active, wherein an update operating mode is enabled when the electronic gaming machine is operating in the second mode and the update logical state is active;

a first network interface that is active during game play; and a second network interface of the electronic gaming machine that is active only when the update operating mode is enabled, the second network interface supporting a direct link to a second electronic gaming machine.

11. The electronic gaming machine of claim 10, wherein the second network interface communicates only with the second electronic gaming machine when the update operating mode is enabled.

12. The electronic gaming machine of claim 10, further comprising a function that disables the first network interface and enables a network portion directly coupled between the second network interface and the second electronic gaming machine when the update operating mode is enabled.

13. The electronic gaming machine of claim 12, wherein the function is a relay.

14. The electronic gaming machine of claim 10, wherein the second network interface is exclusively used for communication of update information when the update operating mode is enabled.

15. A method of operating an electronic gaming machine having a processor, a non-volatile memory, a network interface, and a plurality of modules, the method comprising:

sensing at a first module a physical state of the electronic gaming machine;

placing, via the first module, the electronic gaming machine in a first mode for normal operation when in a first physical state;

connecting a wireless network adapter to the network interface of the electronic gaming machine;

cryptographically authenticating the wireless network adapter at the electronic gaming machine;

placing, via the first module, the electronic gaming machine in a second mode for update operation when in a second physical state;

sensing, via a second module, a logical state of the electronic gaming machine as being in an update logical state;

enabling, via the second module, an update operating mode of the electronic gaming machine when both the update logical state and the second mode of the electronic gaming machine are active; and communicating, via the network interface, update information with a second electronic gaming machine using a wireless network supported by the wireless network adapter, the communicating of the update information occurring only when both the update logical state and the second mode of the electronic gaming machine are active.

16. The method of claim 15, further comprising:

disabling the network interface when the electronic gaming machine is not enabled for the update operating mode.

17. The method of claim 15, wherein communicating the update information with the second electronic gaming machine exclusively when the electronic gaming machine is enabled for the update operating mode comprises:

communicating the update information between the electronic gaming machine and the second electronic gaming machine via a network link exclusively connected between the electronic gaming machine and the second electronic gaming machine.

18. The method of claim 15, wherein cryptographically authenticating the wireless network adapter at the electronic gaming machine comprises authenticating the wireless network adapter to the electronic gaming machine using one of a private key or a public key certificate stored in the electronic gaming machine.

19. The method of claim 15, further comprising performing at the wireless network adapter a cryptographic authentication of an external wireless device prior to communication with the wireless network adapter.

* * * * *